US005467706A

United States Patent [19]

Kato

[11] Patent Number: 5,467,706

[45] Date of Patent: Nov. 21, 1995

[54] MECHANICAL PRESSING MACHINE WITH DYNAMIC BALANCING DEVICE

[75] Inventor: Heizaburo Kato, Shizuoka, Japan

[73] Assignee: Sankyo Seisakusho Co., Tokyo, Japan

[21] Appl. No.: 293,815

[22] Filed: Aug. 22, 1994

[30] Foreign Application Priority Data

Aug. 25, 1993 [JP] Japan ..... 5-210667

[51] Int. Cl.[6] ..... B30B 1/26

[52] U.S. Cl. ..... 100/282; 74/55; 74/603; 83/615; 100/286; 100/292

[58] Field of Search ..... 100/214, 282, 100/280, 286, 292; 72/451, 452; 74/49, 55, 589–591, 603, 604; 83/615, 626, 628

[56] References Cited

U.S. PATENT DOCUMENTS

| | | | |
|---|---|---|---|
| 461,463 | 10/1891 | Willis | 100/292 |
| 493,996 | 3/1893 | Gressett | 100/292 |
| 4,156,387 | 5/1979 | Portmann | 100/257 |
| 4,493,251 | 1/1985 | Green | 100/292 |

FOREIGN PATENT DOCUMENTS

| | | | |
|---|---|---|---|
| 0538582 | 4/1993 | European Pat. Off. . | |
| 144546 | 10/1903 | Germany . | |
| 217943 | 1/1910 | Germany | 100/292 |
| 581140 | 7/1933 | Germany | 83/628 |
| 942554 | 5/1956 | Germany . | |
| 8890008 U | 8/1990 | Germany . | |

OTHER PUBLICATIONS

Übertragungsfunktionen für Kurvengetriebe mit Doppelhubbewegungen, p. 414 Maschinenbautechnik 28 (1979), Prof. Dr.–Ing. habil. J. Volmer (KDT), Dr.–Ing. R. Brock (KDT), Dipl.–Ing. G. Uhlig (KDT) Technische Hochschule Karl–Marx–Stadt.

*Primary Examiner*—Stephen F. Gerrity
*Attorney, Agent, or Firm*—Harness, Dickey & Pierce

[57] ABSTRACT

There is disclosed a mechanical pressing machine utilizing a rotation cam, in which an unbalanced inertia force, produced during a reciprocal movement of a slider, is canceled in a slider system without producing a large flexure in the whole of the pressing machine, thereby enhancing a dynamic precision. The slider and a balance weight are mounted respectively on an upper portion and a lower portion of a frame for vertical sliding movement. The slider and the balance weight are connected through links to a pair of sliding blocks which are reciprocally movable in opposite horizontal directions through a rib cam. With this arrangement, the slider and the balance weight are reciprocally moved vertically in opposite directions, respectively, so that an inertia force of the slider is canceled in the slider system.

6 Claims, 6 Drawing Sheets

MECHANICAL PRESSING MACHINE WITH DYNAMIC BALANCING DEVICE

BACKGROUND OF THE INVENTION

This invention relates to a mechanical pressing machine provided with a dynamic balancing device for balancing an unbalanced inertia force of a reciprocally-moving slider driven by a rotation cam. One known example of mechanical press utilizing a rotation cam is the type of press utilizing a constraint cam such as a yoke mechanism. In such a press, a slider is connected to a follower through a connecting rod, and a rotational motion of the cam is converted into a linear reciprocal motion of the slider. In such a press utilizing the rotation cam, when the operation is started, vibrations, resulting from an unbalanced inertia force due to a reciprocal movement of the slider, develop to produce noises and to cause a positional error, as in a conventional crank press. To avoid this, usually, a dynamic balancing device has been used.

In a conventional dynamic balancing device, an unbalanced inertia force of the reciprocating slider is canceled by a balance weight which is equivalent in weight to the slider, and is connected through a cam or links, supported on a frame, at a position in opposite phase with crests of a cam. With this construction, the unbalanced inertia force in the whole of the press is canceled by the balance weight, and therefore vibrations of the press itself (except for the slider and the moving parts) are reduced,, thereby enabling a high speed operation of the press.

In the above conventional pressing machine, however, directing attention to the slider having an upper die mounted thereon, an inertia force F, produced during the reciprocal movement, produces a flexure $S=F \times K$ in accordance with the rigidity (spring constant) K of a propagation path (generally extending from a follower via a driver to a press frame) of a load. Generally, this flexure S becomes maximum in the vicinity of a lower dead center, and the dimension of the slider is expanded downward, thus adversely affecting the precision at the lower dead center. And besides, this flexure S is proportional to the inertia force, and therefore is increased as the speed increases. Thus, conventionally, although the pressing machine is apparently rendered quiet by the provision of the dynamic balancing device, this has been found not entirely satisfactory from the viewpoint of the dynamic precision such for example as a lower dead center precision and a coining precision.

SUMMARY OF THE INVENTION

With the above problems in view, it is an object of this invention to provide a mechanical pressing machine with a high dynamic precision in which an unbalanced inertia force, produced during a reciprocal movement of a slider, can be canceled in a slider system without producing a large flexure in the whole of the pressing machine.

According to the present invention, there is provided a mechanical pressing machine comprising:

- a slider supported on a frame for vertical sliding movement, the slider having an upper press die mounted on its lower surface;
- a pair of sliding blocks mounted respectively on right and left side portions of the frame for horizontal sliding movement;
- a cam follower and a roller follower rotatably mounted on each of the pair of sliding blocks;

- a pair of right and left connecting rods rotatably connected at their one ends to the pair of sliding blocks, respectively, the other ends of the pair of connecting rods being rotatably connected to the slider;
- a balance weight mounted on an upper portion of the frame for vertical sliding movement;
- a first link having one end rotatably connected to each of the pair of sliding blocks for vertical sliding movement through a slide piece, the other end of the first link being rotatably connected to the balance weight;
- a second link having one end rotatably connected to each of the pair of sliding blocks for vertical sliding movement through the slide piece together with the first link, the other end of the second link being rotatably connected to the slider, and the second link having the same length as that of the first link;
- an input shaft rotatably mounted on the frame, the input shaft being connected at its one end to rotation transmission means; and
- a rib cam fixedly mounted on the other end portion of the input shaft for rotation therewith, the rib cam having a peripheral portion held between the cam follower and the roller follower on each of the pair of sliding blocks so as to reciprocally move the pair of sliding blocks right and left in a symmetrical manner.

Therefore, in the present invention, an inertia force (at least a vertical reciprocal movement) of the slider can be canceled in a slider system without imparting a large load to the pressing machine, and therefore a dynamic precision can be enhanced. A load produced by a die and a pressing operation can be received by the links interconnecting the slider and the balance weight, and the rigidity of the press is determined by a path of propagation of the load, and therefore a lower dead center precision of the press and a coining precision can be enhanced, and vibrations and noises of the press can be reduced.

DESCRIPTION OF THE PREFERRED EMBODIMENTS

Figure 1:
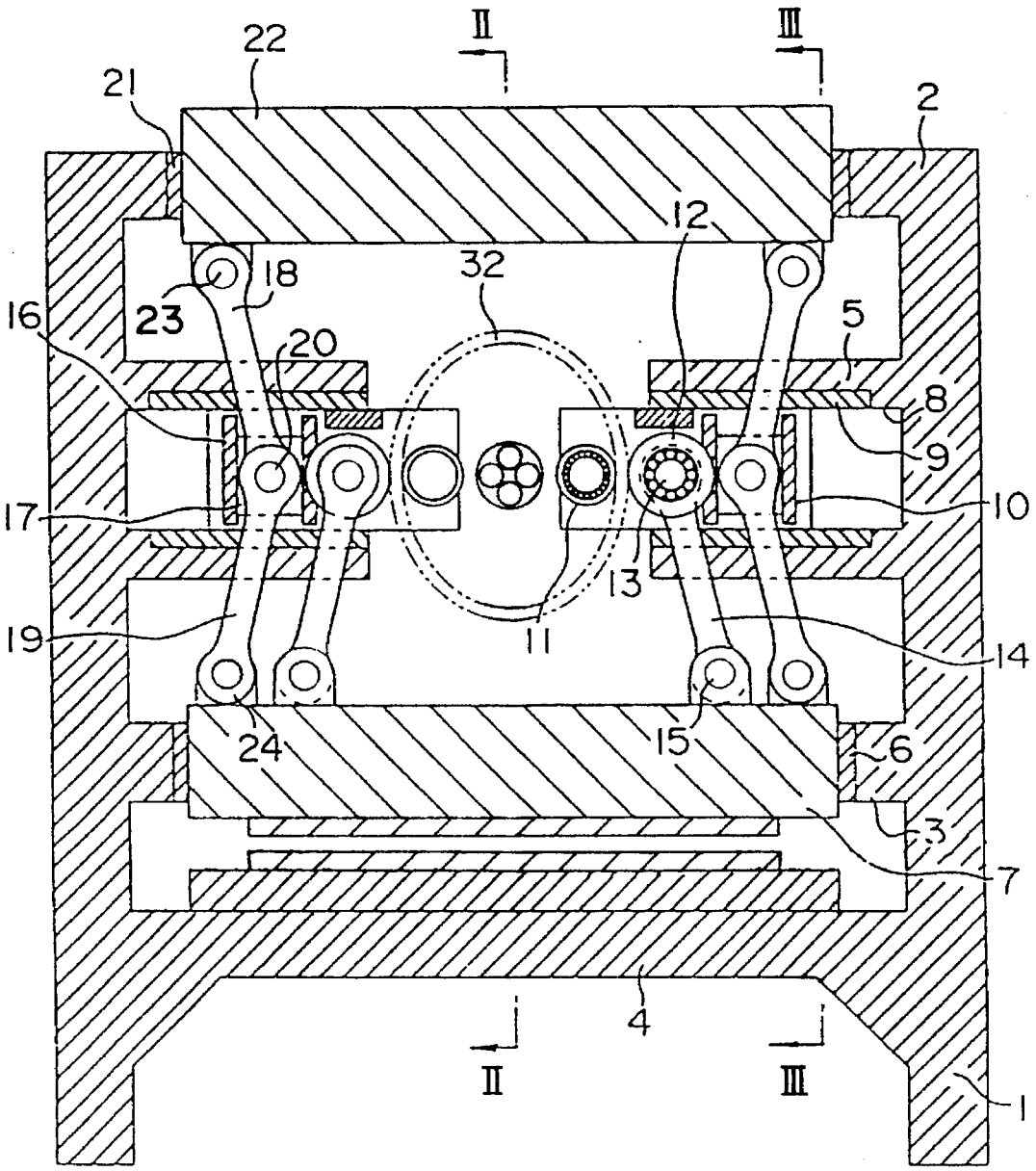
FIG. 1 is a schematic cross-sectional view of one preferred embodiment of a mechanical pressing machine of the present invention as viewed from a front side thereof.
Figure 2:
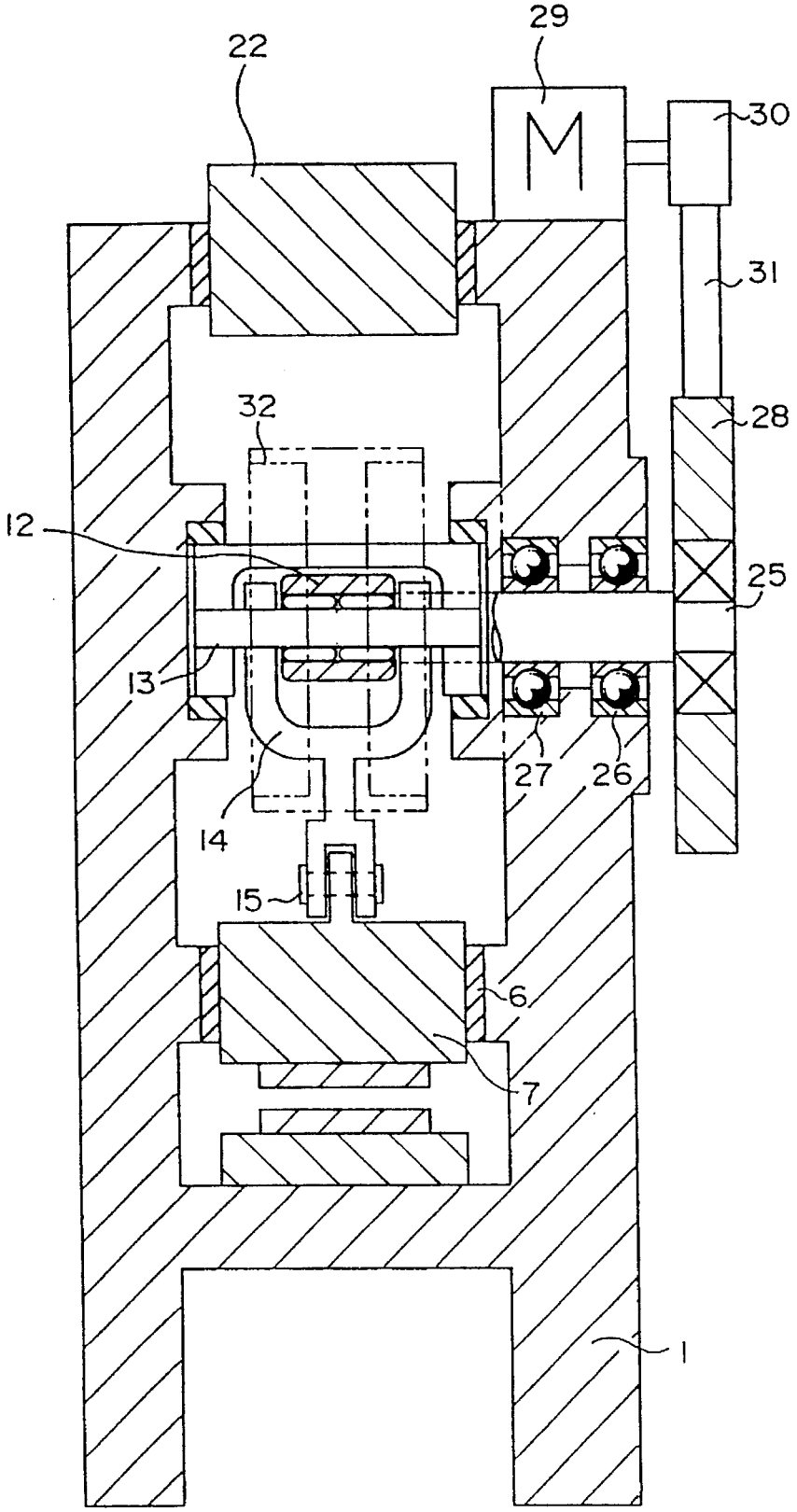
FIG. 2 is a schematic cross-sectional view taken along the line II—II of FIG. 1, as viewed from a side of the pressing machine.
Figure 3:
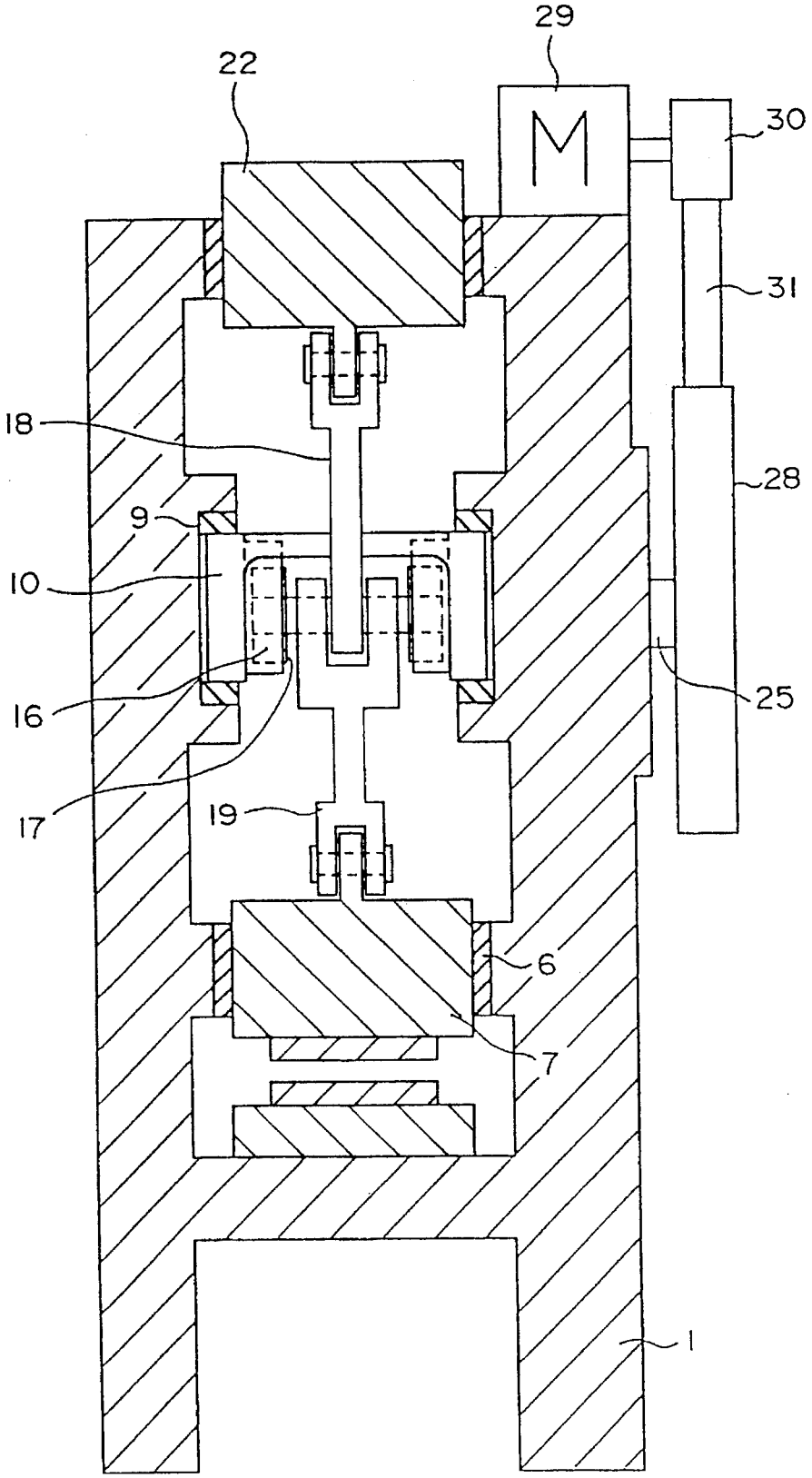
FIG. 3 is a schematic cross-sectional view taken along the line III—III of FIG. 1, as viewed from the side of the pressing machine.
Figure 4:
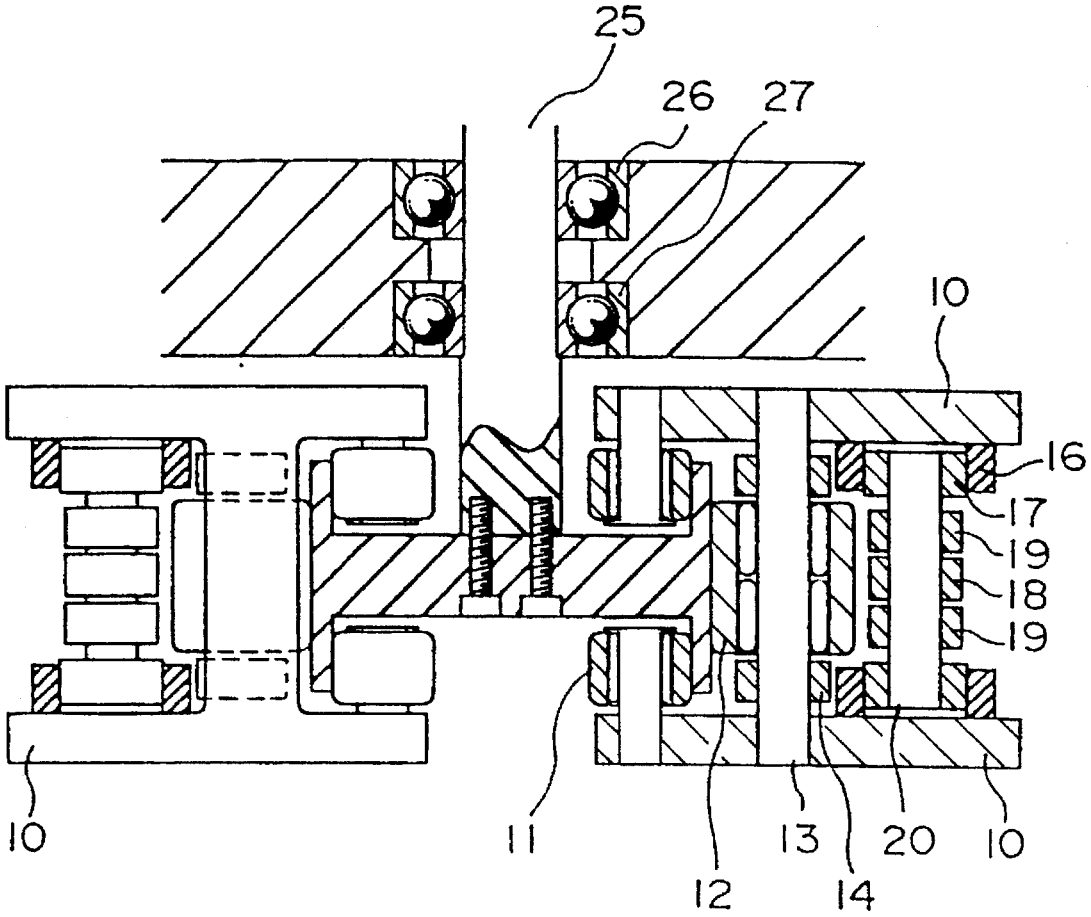
FIG. 4 is a schematic cross-sectional view of a cam mechanism portion as viewed from the top of the pressing machine.

FIG. 1 is a schematic cross-sectional view of one preferred embodiment of a mechanical pressing machine of the present invention as viewed from a front side thereof, FIG. 2 is a schematic cross-sectional view taken along the line II—II of FIG. 1, as viewed from a side of the pressing machine, FIG. 3 is a schematic cross-sectional view taken along the line III—III of FIG. 1, as viewed from the side of the pressing machine, and FIG. 4 is a schematic cross-sectional view of a cam mechanism portion as viewed from the top of the pressing machine. A frame 1 includes an upper support portion 2, an intermediate support portion 3, a lower support portion 4, and a pair of intermediate projection portions 5 which are provided between the upper support portion 2 and the intermediate support portion 3, and are projected inwardly toward each other respectively from right and left side walls of the frame 1. A slider 7 of a rectangular shape is supported through a bearing 6 on the intermediate support portion 3 for sliding movement in a vertical direction. An upper press die is mounted on a lower surface of the slider 7. A guide groove 8 is formed in each of the right and left intermediate projection portions 5, and extends horizontally. A sliding block 10 is slidably received in each of the guide grooves 8 through a bearing 9. Two cam followers 11 are rotatably mounted on an inner portion of each of the pair of right and left sliding blocks 10, and a roller follower 12 is rotatably mounted on an outer portion of each sliding block 10. A connecting rod 14 is rotatably or pivotally mounted at its one bifurcated end on a support shaft 13 for each roller follower 12 in such a manner that the roller follower 12 is received in the bifurcated end of the connecting rod 14. The other bifurcated ends of the two connecting rods 14 are rotatably connected respectively to right and left side portions of an upper surface of the slider 7 through respective connecting pins 15.

A pair of slide guides 16 each having a vertically-extending guide groove are fixedly mounted on each of the sliding blocks 10, and a slide piece 17 is slidably fitted in each of the slide guides 16. A first link 18 and a second link 19 are rotatably connected at their one ends through a connecting pin 20 to the pair of slide pieces 16 on each sliding block 10. The other end of the first link 18 is rotatably connected through a connecting pin 23 to a lower surface of a balance weight 22. The balance weight 22 of a rectangular shape is mounted through a bearing 21 on the upper support portion 2 of the frame 1 for vertical sliding movement. The other end of the second link 19 is rotatably connected to the upper surface of the slider 7 through a connecting pin 24. The balance weight 22 is equal in size to the slider 7, and is equivalent in weight to the slider 7. The first links 18 and the second links 19 have the same length, and are connected to corresponding portions of the balance weight 22 and the slider 7, respectively.

An input shaft 25 is rotatably supported on a rear wall of the frame 1 through bearings 26 and 27, the input shaft 25 extending through the rear wall from a rear side of the frame 1 toward a front side thereof. A flywheel 28 is fixedly mounted on one end of the input shaft 25, and is driven by a motor 29 for rotation through a pulley 30, fixedly mounted on a rotation shaft of the motor 29, and a belt 31 extended around the pulley 30 and the flywheel 28, the motor 29 being mounted on the top of the frame 1. A rib cam 32 is fixedly mounted on the other end portion of the input shaft 25, and has a rim formed at its outer peripheral edge and projected forwardly and rearwardly. The rim of the rib cam 32 is symmetrical with respect to the center or axis of rotation of the rib cam 32. The two cam followers 11 supported on each sliding block 10 are held in contact with an inner peripheral surface of the rim of the rib cam 32 whereas the roller follower 12 supported on each sliding block 10 is held in contact with an outer peripheral surface of the rim of the rib cam 32. The two cam followers 11 and the roller follower 12 supported on each sliding block 10 are rotated in accordance with the rotation of the rib cam 32 to reciprocally move the pair of sliding blocks 10 right and left in opposite directions, that is, toward and away from each other. In order to move the pair of sliding blocks 10 right and left in a symmetrical manner, the rib cam 32 is designed such that S=2n (n=1, 2, 3, 4, . . . ) is established where S represents the number of crests of the rib cam 32. For example, if n= 1 is selected, S=2 is obtained, and therefore there is provided a 180° symmetrical cam in which the number of crests as well as the number of valleys is two. If n= 2 is selected, there is provided a quartered cam in which the number of crests as well as the number of valleys is four, in which case the center of gravity of the cam always coincides with the axis of rotation of the cam, so that the cam has a good rotational balance. The positions of the right and left connecting pins 15 on the upper surface of the slider 7, the positions of the right and left support pins 13 on the sliding blocks 10, and the position of rotation of the rib cam 32 are so determined that the speed is the lowest at a lower dead center of the stroke of the slider 7, thus providing a kind of toggle mechanism.

The operation of the above mechanical pressing machine will now be described. When the motor 29 is rotated to transmit its rotational force to the flywheel 28 via the pulley 30 and the belt 31, the rib cam 32 is rotated or angularly moved from the illustrated position (where the valleys of the rib cam 32 are disposed at the cam followers 11 and the roller followers 12), so that the right and left sliding blocks 10 are moved away from each other from the illustrated positions into right-left symmetrical positions, respectively. In accordance with this movement, each connecting rod 14 is moved toward a vertically-disposed position to move the slider 7 downward from the illustrated upper dead center. At the same time, through the slide guides 16, the slide pieces 17, the first links 18 and the second links 19, the balance weight 22 is moved in a direction opposite to the direction of movement of the slider 7, that is, upward, by a distance equal to the amount of movement of the slider 7. When the rib cam 32 rotates through 90 degrees, so that the crests of the rib cam 32 reach the cam followers 11 and the roller followers 12, the pair of sliding blocks 10 are spaced apart farthest from each other, and the slider 7 is disposed at the lower dead center, thereby working a workpiece, and also the balance weight 22 reaches an upper dead center.

As described above, in this embodiment, the inertia force produced in the descending slider 7 is canceled by the oppositely-directed inertia force of the ascending balance weight 22 through the two second links 19, the slide pieces 17, vertically-movably supported on the sliding blocks 10, and the first links 18. Therefore, a dynamic precision can be enhanced without producing a large flexure in the whole of the pressing machine. Therefore, a pressing load in the vicinity of the lower dead center is received only by the two connecting rods 14, and by shortening the connecting rods the rigidity of the press can be enhanced, and even if the die is subjected to an unbalanced load, the parallelism of the sliding blocks 10 will not be affected.

Figure 5:
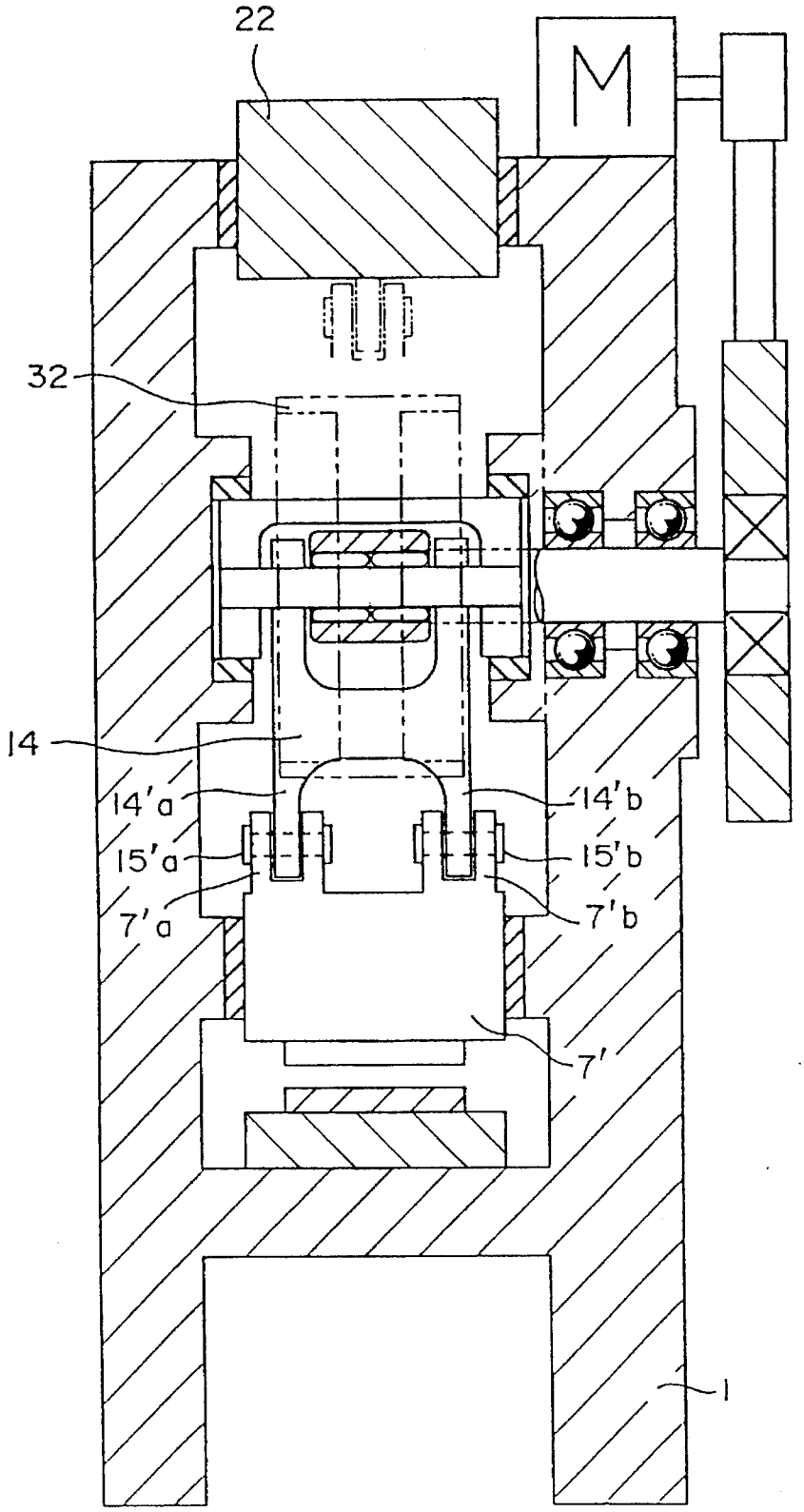
FIG. 5 is a view similar to FIG. 2, but showing a modified mechanical pressing machine of the invention.

FIG. 5 shows a modified form of the invention which differs from the above embodiment only in that the points of connection between a slider 7' and connecting rods 14' are four. More specifically, a pair of bifurcated connecting portions **7'*a* and 7'*b* are formed on each of right and left sides portions of an upper surface of the slider 7'. Two connecting portions 14'*a* and 14'*b* are formed at a lower end of each of the two connecting rods 14', and are rotatably connected by respective connecting pins 15'*a* and 15'*b* to the connecting portions 7'*a* and 7'*b*, respectively. The other construction is the same as that of the first embodiment, and therefore explanation thereof will be omitted. In this embodiment, because of the four-point connection arrangement, the slider 7'** is prevented from being tilted not only right and left but also forwardly and rearwardly.

Figure 6:
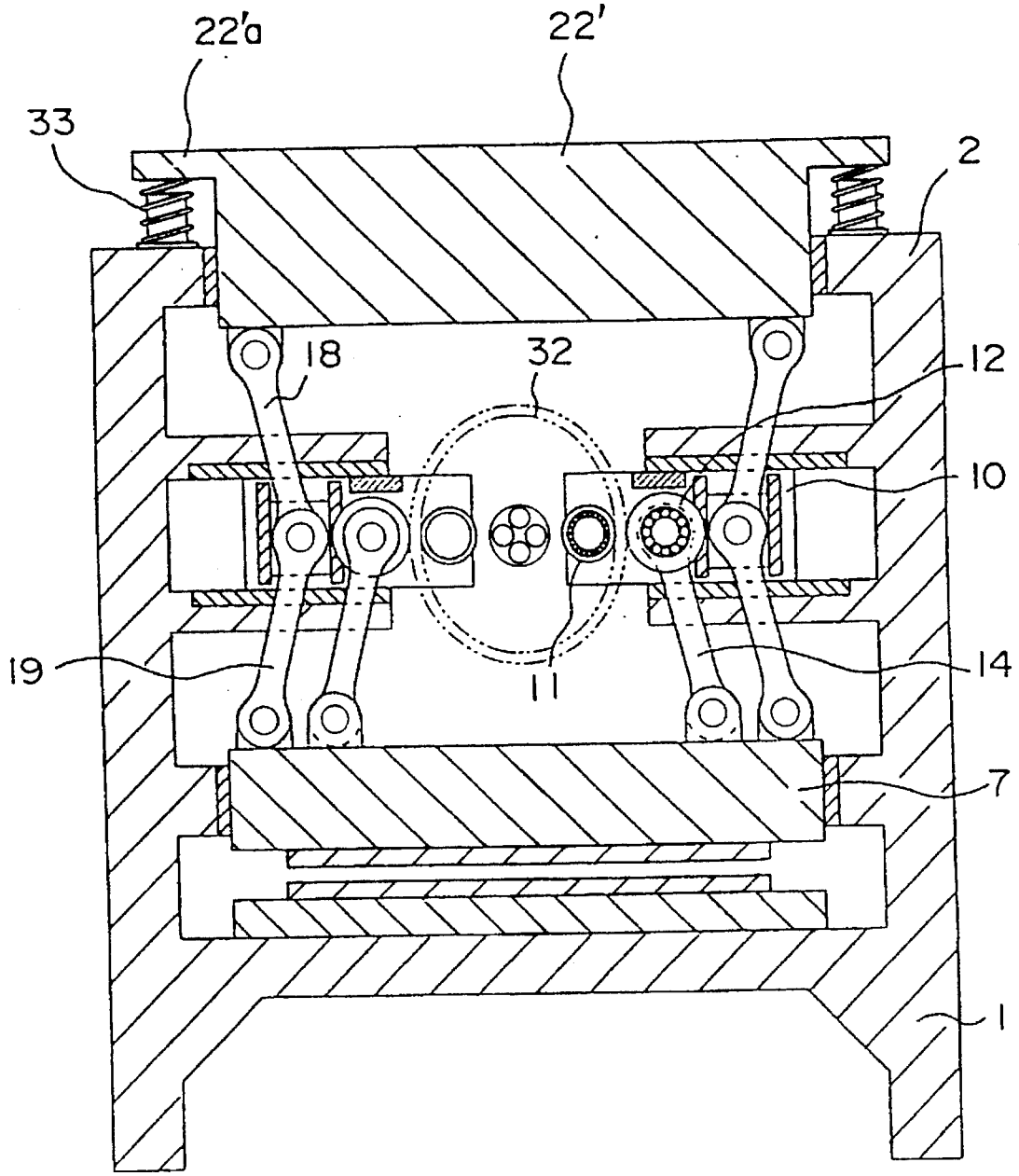
FIG. 6 is a view similar to FIG. 1, but showing another modified mechanical pressing machine of the invention.

FIG. 6 shows another modified form of the invention. In this embodiment, a flange 22'*a* is formed on each of opposite (right and left) sides of a balance weight 22', and a compression coil spring 33 is provided between each flange 22'*a* and an upper support portion 2 of a frame 1. The other construction is the same as that of the first embodiment, and therefore explanation thereof will be omitted. In this embodiment, since the balance weight 22' is supported on the frame 1 by the compression coil springs 33, any extra load other than that used for adjusting the balance of the slider 7 can be absorbed. This construction can be applied to both of the two-point press of FIG. 2 and the four-point press of FIG. 5.

As described above, in the present invention, since the slider and the balance weight are connected together through the links, an unbalanced inertia force of the slider can be canceled in the slider system, and therefore the dynamic precision can be enhanced without producing a large flexure in the whole of the pressing machine. And besides, since the load, produced by the die and the pressing operation, is received by the connecting rods and the links interconnecting the slider and the balance weight, the rigidity of the press is enhanced, so that vibrations and noises of the press can be reduced. Furthermore, the rib cam, the sliding blocks and the connecting rods jointly constitute a kind of toggle mechanism, and therefore there can be achieved the mechanical pressing machine which is simple in construction, is short in stress path, well withstands an impact load of the press and an unbalanced load, and is less affected thermally. Moreover, because of the toggle effect, the speed is reduced in the vicinity of the lower dead center, and therefore there can be provided the mechanical pressing machine which is highly precise at the lower dead center, and reduces noises. Furthermore, there can be achieved advantageous effects that a curve of motion can be freely selected since the cam is used as a driver, that a good rotational balance can be obtained since the number of crests of the cam is set to an integral multiple of 2, and that the efficiency of the operation is high since the cam mechanism of the rolling pair is used.

What is claimed is:

1. A mechanical pressing machine comprising:

a slider supported on a frame for vertical sliding movement, said slider having an upper press die mounted on its lower surface;

a pair of sliding blocks mounted respectively on right and left side portions of said frame for horizontal sliding movement;

a cam follower and a roller follower rotatably mounted on each of said pair of sliding blocks;

a pair of right and left connecting rods rotatably connected at their one ends to said pair of sliding blocks, respectively, the other ends of said pair of connecting rods being rotatably connected to said slider;

a balance weight mounted on an upper portion of said frame for vertical sliding movement;

a first link having one end rotatably connected to each of said pair of sliding blocks for vertical sliding movement through a slide piece, the other end of said first link being rotatably connected to said balance weight;

a second link having one end rotatably connected to each of said pair of sliding blocks for vertical sliding movement through said slide piece together with said first link, the other end of said second link being rotatably connected to said slider, and said second link having the same length as that of said first link;

an input shaft rotatably mounted on said frame, said input shaft being connected at its one end to rotation transmission means; and a rib cam fixedly mounted on the other end portion of said input shaft for rotation therewith, said rib cam having a peripheral portion held between said cam follower and said roller follower on each of said pair of sliding blocks so as to reciprocally move said pair of sliding blocks right and left in a symmetrical manner.

2. A mechanical pressing machine according to claim 1, in which said other end of each of said pair of connecting rods is connected to said slider at two points.

3. A mechanical pressing machine according to claim 2, in which said rib cam has-a rim formed at its outer peripheral edge which rim is held between said cam follower and said roller follower mounted on each of said pair of sliding blocks, said rim being symmetrical with respect to an axis of rotation of said rib cam, and said rim having crests the number of which is an integral multiple of 2.

4. A mechanical pressing machine according to claim 3, in which said first link and said second link for each of said sliding blocks are rotatably supported on said slide piece, and said slide piece is fitted in a slide guide for vertical sliding movement which slide guide is provided on each of said sliding blocks.

5. A mechanical pressing machine according to claim 1, in which said rib cam has a rim formed at its outer peripheral edge which rim is held between said cam follower and said roller follower mounted on each of said pair of sliding blocks, said rim being symmetrical with respect to an axis of rotation of said rib cam, and said rim having crests the number of which is an integral multiple of 2.

6. A mechanical pressing machine according to claim 5, in which said first link and said second link for each of said sliding blocks are rotatably supported on said slide piece, and said slide piece is fitted in a slide guide for vertical sliding movement which slide guide is provided on each of said sliding blocks.

* * * * *